US005813887A

United States Patent [19]

Mark

[11] Patent Number: 5,813,887

[45] Date of Patent: Sep. 29, 1998

[54] MARINE PROPULSION SYSTEM

[76] Inventor: Theodore Mark, R.R. #3, Site 312, C-16, Port Alberni, British Columbia, Canada, V96 7L7

[21] Appl. No.: 821,069

[22] Filed: Mar. 20, 1997

[51] Int. Cl.[6] ..... B63H 23/00

[52] U.S. Cl. ..... 440/5; 440/75

[58] Field of Search ..... 440/53, 57, 58, 440/62, 75, 83, 111

[56] References Cited

U.S. PATENT DOCUMENTS

| | | | |
|---|---|---|---|
| 3,403,655 | 10/1968 | Warburton | 440/75 |
| 3,673,978 | 7/1972 | Jeffery et al. | 440/5 |
| 4,992,066 | 2/1991 | Watson | 440/75 |

*Primary Examiner*—Ed L. Swinehart
*Attorney, Agent, or Firm*—Oyen Wiggs Green & Mutala

[57] ABSTRACT

In prior stern drive marine propulsion systems, power is transmitted through an arrangement of clutches, bevel gears and shafts to the propeller located below the water surface. This restricts the amount of torque which can be transmitted particularly for large commercial boats. The present invention therefore provides an outdrive designed to surpass the horsepower and torque limitations set by current state-of-the-art units. In order to meet these objectives the outdrive was designed to incorporate a multi-strand roller chain drive, replacing the conventional bevel gear arrangement. Using a chain drive in this application serves to increase durability of the outdrive, while keeping the outercasing very streamlined.

7 Claims, 3 Drawing Sheets

MARINE PROPULSION SYSTEM

TECHNICAL FIELD

The invention relates to the field of marine propulsion systems. More particularly, the invention relates to stern mounted drives or outboard marine propulsion systems in which the inboard engine drives some form of transmission and an intermediate drive shaft mounted outboard of the transom, which in turn drives a propeller shaft.

BACKGROUND ART

Stern mounted, or outboard marine propulsion systems have a number of advantages over conventional systems like the fixed propeller systems in which an onboard engine drives a fixed propeller shaft through a marine transmission and steering is provided by a rudder, and over purely outboard systems in which the entire engine, drivetrain and propeller are located aft of the transom. Stern mounted drives combined with inboard engines offer more mobility than fixed propeller systems, and greater horsepower than purely outboard units. The term "outboard drive" refers to the fact that the entire drive unit apart from the engine and transmission are located overboard, on the transom of the boat. This feature is critical to the vessel's trim, tilt and steering operations. With this type of system propulsion is achieved when rotation is transmitted from an inboard mounted engine through some form of drive train to a propeller located below the water line. Instead of a rudder setup, steering is executed by changing the angle of the entire unit in a plane parallel to the water surface. By varying this angle, propeller thrust is redirected and the vessel's course altered. The ability to direct propeller thrust makes the vessel responsive and extremely maneuverable, a feature that appeals to both commercial and pleasure boat owners.

In existing stern drive propulsion systems, rotation from the inboard power plant is reduced by the transmission and then directly coupled to the outboard leg using a universal joint. Power is then transmitted through an arrangement of clutches, bevel gears and shafts to the propeller located below the water surface. Such fixed gear ratio arrangements tend not to use fuel to the utmost efficiency. For example, accelerating a boat from a standstill requires more horsepower than any other time during operation, and this occurs when the engine is running at low rpm and producing very little horsepower. At that time engines are overfuelled in order to create more horsepower. However most of this excess fuel that is delivered to the engine is exhausted and not used. Also, particular engines, and particularly diesel engines, have a peak performance within a narrow rpm range, so in fixed ratio systems, the engine will be operating efficiently in a limited number of boat speeds and so most often will be operating with reduced fuel efficiency, causing increased costs and pollution.

Currently the largest outboard drives on the market are made of cast aluminum and do not adequately withstand the magnitude or the duration of the torque required by larger commercial boats (greater than 400 ft.-lb. of torque). In existing designs, an increase in torque would mean that the running gear would have to be made substantially more robust, and so could no longer be contained within a streamlined lightweight casing. Instead, the case would have to be made larger and more bulky in an attempt to withstand the inherent side thrust associated with bevel gears. In higher speed applications where this unit is desirable, such a massive leg would compromise fuel efficiency with its increased mass and multiplied drag. As a result, current manufacturers have designed outboard drives that are more suited to high speed (3000–5000 rpm), gasoline-fuelled engines with relatively low torque. These restrictions have shaped their trim, lightweight drives to be suitable for pleasure boats and light duty commercial vessels with low operating hours. However, the maneuverability of these drives still appeals to customers operating heavier boats under more abusive conditions. With such operating benefits, larger commercial operators still choose to purchase these lightweight units which results in the need for costly repairs after very low hours.

Using thrust vectoring to steer the boat, rather than the traditional fixed propeller and rudder setup has considerable advantages in maneuverability. However there are some disadvantages. The universal joint which must penetrate the transom of the boat is both a weak link in the drive train, as well as a difficult area to seal.

Consequently various designs have been proposed wherein the inboard engine is used to drive a hydraulic pump, and the hydraulic pump provides hydraulic fluid under pressure to an outboard reversible hydraulic motor which drives the propeller shaft. For example, in U.S. Pat. Nos. 3,139,062 Keefe issued Jun. 30, 1964; 3,587,595 Buddrus issued Jun. 28, 1971; 3,599,595 James issued Aug. 17, 1971; and 3,847,107, propulsion units are disclosed in which a hydraulic motor is mounted on the propeller shaft, below the water line. Such designs result in large drag factors due to the volume of the housing which is below the water line. Other designs such as shown in U.S. Pat. Nos. 2,486,049 Miller, issued Oct. 25, 1949; 3,673,978 Jeffrey et al. issued Jul. 4, 1972, all provide the hydraulic motor above the water line, and connect the motor to the propeller shaft through bevel gears. The disadvantage of such designs however is that again for such bevel gear connections, the running gear would have to be made substantially more robust for high torque applications, and so could no longer be contained within a streamlined lightweight casing. The case would have to be made larger and more bulky in an attempt to withstand the inherent side thrust associated with bevel gears. In higher speed applications where this unit is desirable, such a massive leg would compromise fuel efficiency with its increased mass and multiplied drag.

There is therefore a need for an outboard drive system which will satisfy the higher horsepower/torque requirements of larger commercial vessels, as well as compete with existing outboard drives.

DISCLOSURE OF INVENTION

The present invention therefore provides an outdrive designed to surpass the horsepower and torque limitations set by current state-of-the-art units. In order to meet these objectives the outdrive was designed to incorporate a multistrand roller chain drive, replacing the conventional bevel gear arrangement. Using a chain drive in this application serves to increase the horsepower rating of this type of drive and increase the durability of the outdrive, while keeping the outer casing very streamlined.

The invention therefore provides a marine propulsion system, comprising: i) a transom; ii) an engine inboard of the transom; iii) a steerable screw propulsion unit outboard of the transom, and comprising a propeller shaft mounted for rotation in the propulsion unit and having a propeller mounted thereon; iv) a drive shaft mounted for rotation in the propulsion unit parallel to the propeller shaft; v) means for transferring power from the engine to rotate the drive shaft; and vi) flexible belt means for coupling the drive shaft to the propeller shaft and thereby transferring rotational energy from the drive shaft to the propeller shaft. Preferably the means for transferring power from the engine to rotate the drive shaft comprises a hydraulic pump inboard of the transom and coupled to be driven by the engine, a reversible hydraulic motor mounted on the propulsion unit and coupled to drive the drive shaft, and fluid conduits communicating between the hydraulic pump and the hydraulic motor to transfer pressurized fluid from the hydraulic pump to the hydraulic motor.

BRIEF DESCRIPTION OF DRAWINGS

In drawings illustrating a preferred embodiment of the invention.

BEST MODE(S) FOR CARRYING OUT THE INVENTION

Figure 1:
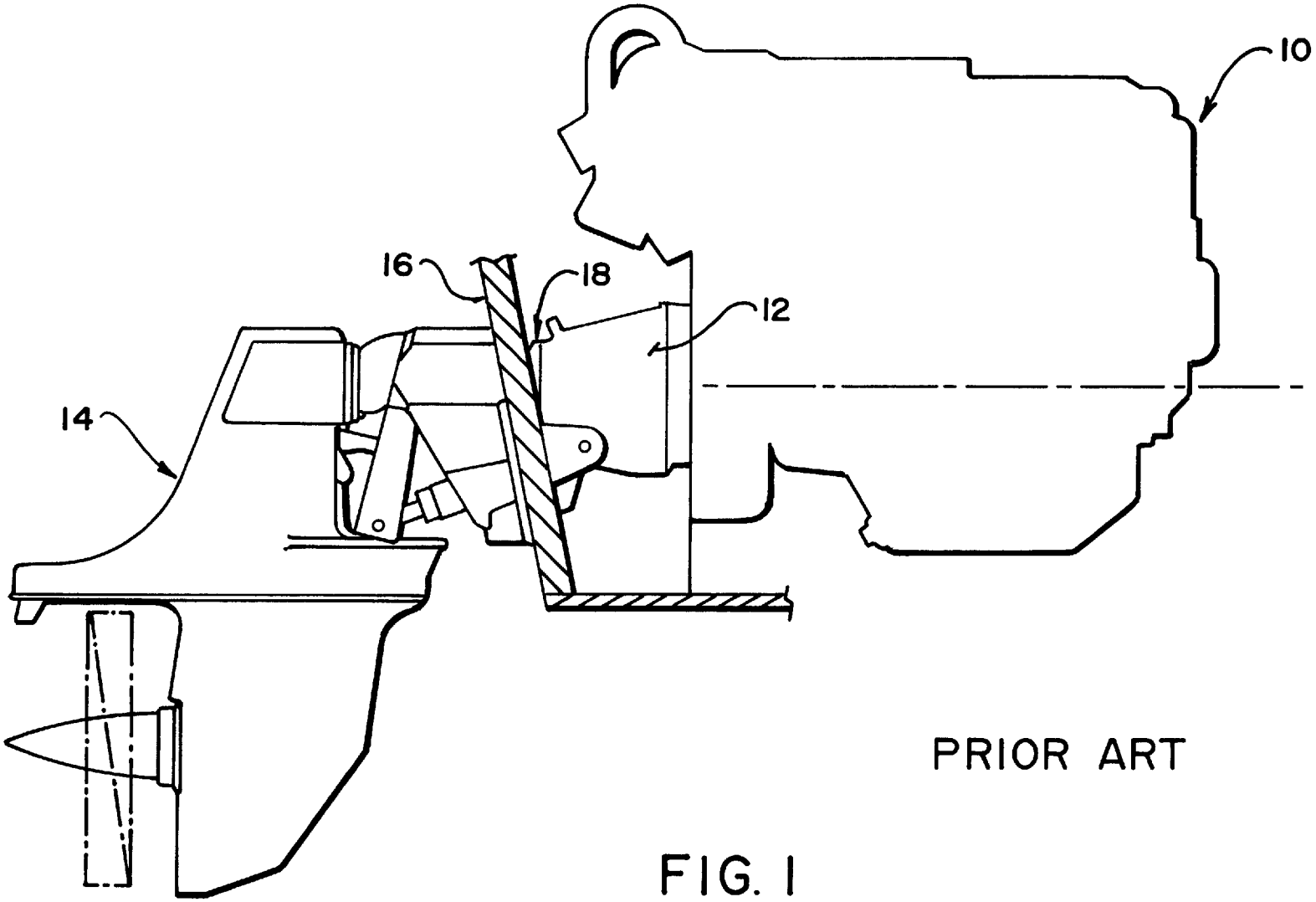
PRIOR ART FIG. 1
FIG. 1 is a schematic illustration of a prior art stern drive system.

In the prior art propulsion system shown in FIG. 1, an internal combustion engine 10, mounted inboard, has a fixed ratio transmission 12 mounted directly inline with it. The outboard drive unit 14 is connected through the transom 16 to the transmission 12 via a universal joint 18.

Figure 2:
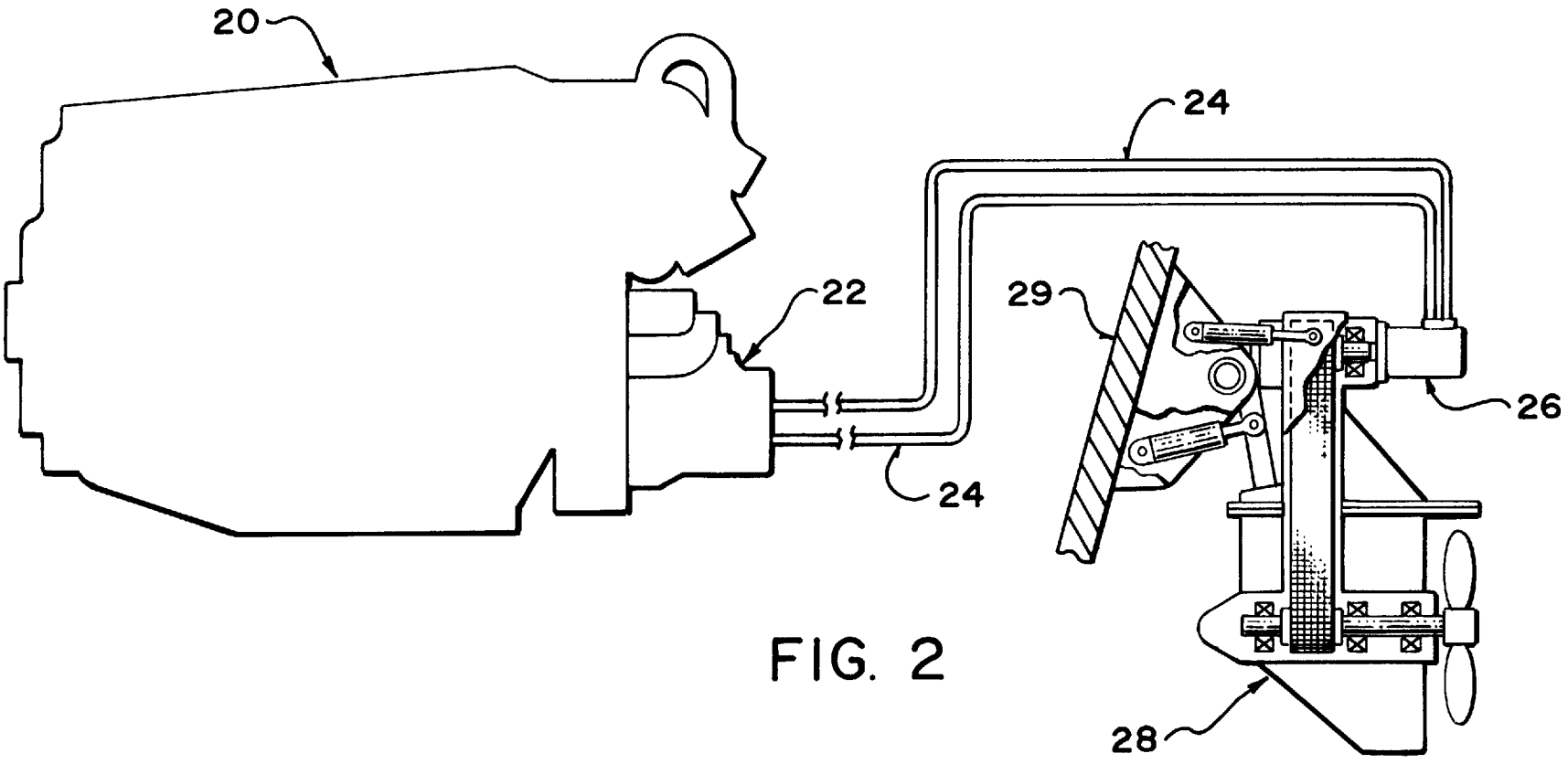
FIG. 2 is a schematic illustration of the marine propulsion system according to the present invention.

In the marine propulsion system of the present invention shown in FIG. 2, internal combustion engine 20, mounted inboard, drives a variable displacement pump 22. Pump 22 provides hydraulic fluid under pressure, through hydraulic conductors 24, to a reversible hydraulic motor 26 mounted on the outboard drive 28, outboard of the transom 29. A suitable hydraulic pump and motor system for use with a 250 horsepower engine producing 500 foot-pounds of torque is the EATON™ Hydrostatic Transmission Model 76 pump and Model 54 motor.

Figure 4:
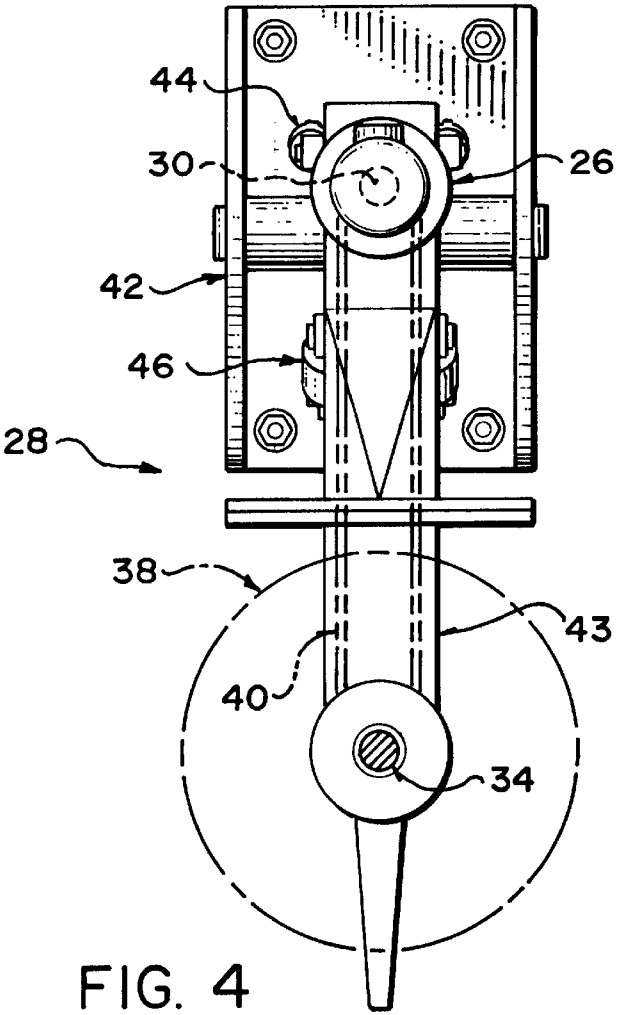
FIG. 4 is a rear view of the drive unit shown in FIG. 3.
Figure 3:
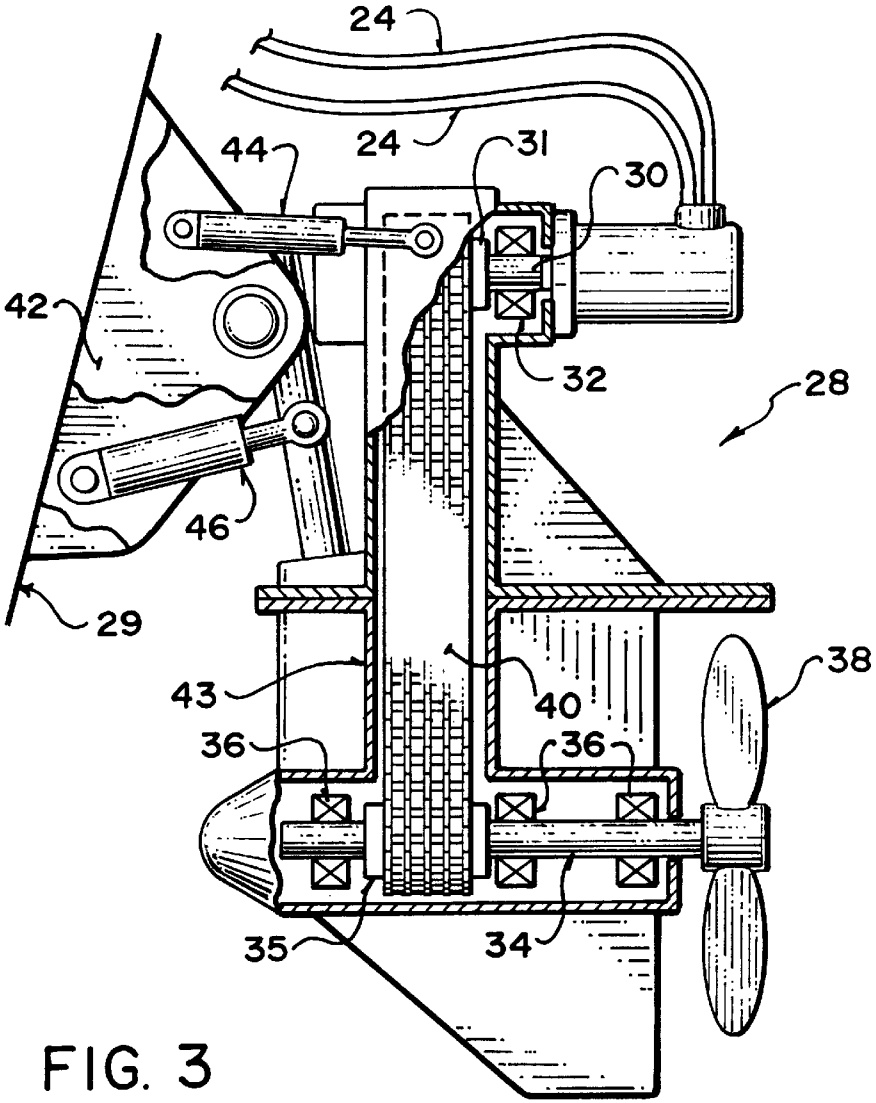
FIG. 3 is a side elevation, partially cut-away, of the drive unit for the marine propulsion system according to the present invention.

The drive unit of the invention is shown in more detail in FIGS. 3 and 4. While in the preferred embodiment of this system, rotation is transmitted from the inboard engine 20 to the top shaft 30 of the outdrive by a variable hydraulic transmission including a reversible hydraulic motor 26 as described above, other sources of rotation from the source, either inboard or outboard, can be used to couple the rotation to the top shaft of the outdrive, such as by a conventional engine/gear-type system. The top shaft 30 comprises a multi-strand sprocket supported by an arrangement of bearings 32. The propeller shaft 34, located in the lower portion of the drive 28, comprises another multi-strand sprocket 35 and is supported by an arrangement of bearings 36. Propeller 38 is mounted on shaft 34. Linking the two parallel shafts 30, 34 is a fixed ratio chain reduction that may vary depending on the application, whether conventional or hydraulic. This reduction is achieved using a durable, multi-strand roller chain 40 such as a DIAMONDυ multi-strand chain. The chain is lubricated by an oil bath (not shown) or pressurized stream lubrication, and kept taut using a standard form of idler arrangement. Typically, multi-strand chains consist of two more lengths of roller chain that are joined side by side to form a wide belt. By adding more strands of chain or changing the pitch (link size) of the chain, the amount of torque transmitted can be greatly increased without making the outer dimensions of the chain case any wider. Also by replacing the prior art bevel gear drive with a chain, the loads in the drive train become pure radial loads as opposed to combined radial and thrust loads. These pure radial loads require only radial-type bearings which are much smaller in diameter than a similar combined radial and thrust bearing used with bevel gear system. The advantages over the prior art systems are greater torque capacity, longer bearing life and improved durability, without compromising the streamlined casing profile.

The outer casing 43 may be fabricated or cast to include all appropriate hydrodynamic features, such as steering and planing fins. The drive unit 28 is mounted on the transom 29 by mounting bracket 42. Steering and trim are accomplished using standard hydraulic steering cylinders 44 and trim cylinders 46.

By combining the aforesaid chain drive unit design with the hydraulic coupling from the engine to the drive unit, further benefits are obtained. Increasing or lowering the speed of the boat can be achieved through adjustment of the pump's flow control rather than varying the engine speed. The bi-directional hydraulic motor permits immediate shifting into reverse, and unlimited propeller speed is possible in both forward and reverse. This arrangement allows the engine to be operated constantly in its most efficient range of engine speeds from the standpoint of greatest torque and fuel efficiency. This is generally a relatively low rpm, which prolongs engine life and reduces unburned fuel emissions. Also the universal joint connection is eliminated and the pump and outboardlocated motor are connected only by hydraulic lines, which improves the design flexibility for location of the engine and pump within the boat and reduces the area of openings through the transom. Two outboard drives can be powered by a single inboard engine.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A marine propulsion system, comprising:

i) a transom;

ii) an engine inboard of the transom;

iii) a steerable screw propulsion unit outboard of the transom, and comprising a propeller shaft mounted for rotation in said propulsion unit and having a propeller mounted thereon;

iv) means for transferring power from said engine to rotate said propeller shaft comprising a hydraulic pump inboard of said transom and coupled to be driven by said engine, a reversible hydraulic motor having a drive shaft and mounted in the propulsion unit whereby said drive shaft rotates on an axis in said propulsion unit above and parallel to the axis of rotation of said propeller shaft, and fluid conduits communicating between said hydraulic pump and said hydraulic motor to transfer pressurized fluid from said hydraulic pump to said hydraulic motor; and v) flexible belt means for coupling said drive shaft to said propeller shaft and thereby transferring rotational energy from said drive shaft to said propeller shaft, and wherein said drive shaft and said propeller shaft comprise sprockets for receiving said flexible belt means.

2. The marine propulsion system of claim 1 wherein said flexible belt means comprises a plurality of roller chains.

3. The marine propulsion system of claim 2 further comprising a volume of lubricant in contact with said plurality of roller chains.

4. The marine propulsion system of claim 3 wherein said volume of lubricant in contact with said plurality of roller chains comprises an oil bath.

5. The marine propulsion system of claim 1 wherein said sprockets on said drive shaft and said propeller shaft are selected to provide a fixed ratio reduction.

6. The marine propulsion system of claim 5 wherein said sprockets are adapted to receive a variable number of strands of chain to vary the amount of torque transmitted.

7. The marine propulsion system of claim 5 wherein said sprockets are adapted to receive chain of a variable pitch to vary the amount of torque transmitted.

* * * * *